US006098778A

United States Patent [19]

Yeh

[11] Patent Number: 6,098,778

[45] Date of Patent: Aug. 8, 2000

[54] COIN COLLECTING MECHANISM WITH TOP COIN SLOT AND COIN RETURN FUNCTION

[76] Inventor: Young-Chin Yeh, 2F, No. 70, Wu Hua Street, San Chuong City, Taipei Hsien, Taiwan

[21] Appl. No.: 09/306,777

[22] Filed: May 7, 1999

[51] Int. Cl.[7] ..... G07D 5/08; G07D 5/02; G07F 1/04

[52] U.S. Cl. ..... 194/318; 194/321; 194/338; 194/345

[58] Field of Search ..... 194/345, 321, 194/334, 338, 346, 317, 318, 319

[56] References Cited

U.S. PATENT DOCUMENTS

| | | | |
|---|---|---|---|
| 4,984,670 | 1/1991 | Merkle | 194/334 |
| 5,080,216 | 1/1992 | Abe | 194/334 |
| 5,915,519 | 6/1999 | Glaser | 194/345 |

FOREIGN PATENT DOCUMENTS

| | | | |
|---|---|---|---|
| 207694 | 9/1966 | Sweden | 194/345 |
| 925094 | 5/1963 | United Kingdom | 194/321 |

*Primary Examiner*—Robert P. Olszewski
*Assistant Examiner*—Bryan Jaketic
*Attorney, Agent, or Firm*—Dougherty & Troxell

[57] ABSTRACT

A coin collecting mechanism with top coin slot and coin return function is provided. The coin collecting mechanism has a main support onto which both a coin return mechanism and a coin comparison mechanism are mounted. The coin comparison mechanism is in a vertical position but inclined backward by about 15 degrees. The coin return mechanism includes a hood defining a downward opened chamber for the coin comparison mechanism to move up and down therein. The hood is provided at a lower front end with a horizontal rail inclined backward by about 15 degrees for catching an inserted coin vertically falling from the coin slot and guiding the coin into the coin comparison mechanism. The hood also has a spring-loaded member mounted thereto for pushing a jammed coin out of the inclined rail. A locating clamp is adjustably mounted on the hood for easily adjusting a size of the coin slot. An electromagnetic valve included in the coin collecting mechanism has a return spring mounted inside the valve body without the risk of contacting and tangling with electric wires outside the electromagnetic valve.

3 Claims, 11 Drawing Sheets

COIN COLLECTING MECHANISM WITH TOP COIN SLOT AND COIN RETURN FUNCTION

BACKGROUND OF THE INVENTION

The present invention relates to a coin collecting mechanism with top coin slot, and more particularly to a coin collecting mechanism with top coin slot and coin return function.

The coin collecting mechanism is mainly mounted in vending machines, TV games, etc. for collecting and screening coins paid by users via a coin slot thereof, so that incorrect or illegal coins may be rejected. The currently available coin collecting mechanisms may be generally divided into top coin slot type and side coin slot type if classified by the way of inserting the coin into the mechanism. In either type, the coin collecting mechanism with electronic coin comparison function is most practical for use.

FIG. 1 is a perspective of a conventional coin collecting mechanism A having a coin slot Al provided at a lateral side of the mechanism. A coin inserted into the coin slot A1 passes a slowly inclined passage inside a coin-return hood A2 and enters an inner slideway A4 of a coin comparison mechanism A3. The coin comparison mechanism A3 also has an outer slideway A5 in parallel with the inner slideway A4 for holding a sample coin thereto. A spring is provided at one side of the coin comparison mechanism A3, such that the latter may be moved up and down in the vertical direction of the slideways A4 and A5. The movable coin comparison mechanism A3 on the one hand allows replacement of differently sized sample coin into the outer slideway A5, and on the other hand normally keeps the sample coin at a lowered position to press against a bottom of the slideway A5 to provide a reference for electronic coin comparison. A handle A6 is provided outside the coin collecting mechanism A. When the handle A6 is pushed counterclockwise, the coin-return hood A2 is caused to move away from its original position by a small distance, so that a coin jammed in the passage inside the hood A2 may fall from the hood A2 to a coin return bucket A7. From the above description, it can be seen that the coin collecting mechanism A with side coin slot Al has both the functions of comparing an inserted coin with a sample coin and returning an inserted coin that does not pass the coin comparison mechanism A3 and is jammed in the coin-return hood A2. However, the coin collecting mechanism A with a side coin slot A1 occupies a considerable big space.

FIG. 2 is a perspective of another conventional coin collecting mechanism B with a top coin slot B1. A coin inserted into the coin slot B1 vertically falls and enters an internal passage. The coin collecting mechanism B does not have an electronic coin comparison mechanism but has a coin return mechanism. When a handle B2 is pushed downward, a protruded bar B3 integrally connected to the handle B2 downward presses an inclined surface on a coin-return hood B4 to force the hood B4 to move outward, so that a coin jammed in the hood B4 falls into a coin-return passage and is sent to a coin return outlet.

U.S. Pat. No. 4,437,558 discloses a coin detector apparatus with a top coin slot. The mechanism includes a coin comparison mechanism but not a coin return mechanism. A coin inserted into the top coin slot quickly passes a very steep passage in the coin comparison mechanism and therefore can not be accurately compared to a sample coin for its correctness. And, since the coin collecting mechanism does not include a coin return mechanism, a jammed coin will cause great inconvenience to users.

Following drawbacks are usually found in the conventional coin collecting mechanism with top coin slot:

1. In view that the problem of coin jam would occur in any type of coin collecting mechanism after the coin collecting mechanism has been used for a long time, it is therefore necessary to provide a coin return mechanism in the coin collecting mechanism. A coin collecting mechanism with top coin slot usually has fixed dimensions, such as 3.5" in length and 4" in height and is therefore unable to include both the electronic coin comparison mechanism and the coin return mechanism in the coin collecting mechanism. Currently, most coin collecting mechanisms with top coin slot and electronic coin comparison mechanism do not have a coin return mechanism and are therefore imperfect in their functions.

U.S. Pat. No. 4,437,558 entitled "Coin Detector Apparatus" as mentioned above discloses a coin collecting apparatus having top coin slot and electronic coin comparison function but not the coin return function. On the other hand, U.S. Pat. No. 5,697,484 entitled "Electronic Coin Collecting Mechanism" discloses a coin collecting mechanism having a side coin slot. The mechanism is not limited in its dimensions and therefore has a volume big enough for including both the electronic coin comparison mechanism and the coin return mechanism. Therefore, it is a big problem of the coin collecting mechanism with top coin slot having not a coin return mechanism.

2. The examination of coin by the coin comparison mechanism necessitates a minimum time for the coin to pass the coin comparison mechanism. It is possible the coin passes through the coin comparison mechanism too fast to allow accurate comparison and correct determination. In the currently available coin collecting mechanisms with top coin slot and coin comparison mechanism, the inserted coin always passes a steep slideway (having an inclination larger than 45 degrees) and would therefore pass the comparison mechanism too fast to be accurately examined. This problem is also found in the coin detector apparatus disclosed in the above-mentioned U.S. Pat. No. 4,437,558.

3. Conventional coin return mechanism included in the coin collecting mechanisms, including those with top coin slot and those with side coin slot, is operated by manipulating a lever to push a hood away from a main support of the coin collecting mechanism by a small distance, so that a jammed coin would automatically fall onto a coin-return passage. However, the jammed coin does not always easily fall onto the coin-return passage because the small distance between the main support and the pushed-away hood of the coin return mechanism. An operator or user might have to manipulate the lever several times to have the jammed coin fall down.

4. In the conventional coin collecting mechanism with top coin slot, there is usually a locating clamp provided at the coin slot for primarily setting a size of coin that can be accepted by the coin slot. The locating clamp is normally fixedly connected to the coin slot. Whenever the previously set coin size is to be adjusted, it is necessary to dismount the locating clamp and many other accessories. This type of locating clamp is therefore inconvenient for use in a coin collecting mechanism having electronic coin comparison mechanism therein.

5. In the conventional coin collecting mechanism, there is an electromagnetic valve for controlling the coin passages. A return spring of the electromagnetic valve is located at outside of the valve body and tends to tangle with electric wires in the mechanism and causes damages during the assembling and/or operation of the whole mechanism.

It is therefore desirable to develop a coin collecting mechanism with top coin slot that can include both the electronic coin comparison mechanism and the coin return mechanism and eliminates the drawbacks existing in the conventional coin collecting mechanisms with top coin slot.

SUMMARY OF THE INVENTION

A primary object of the present invention is to provide a coin collecting mechanism with top coin slot that includes a coin comparison mechanism vertically mounted on a main support of the coin collection mechanism but at an inclination about 15 degrees, and a coin return mechanism including a hood connected at a rear edge to the main support for covering the coin comparison mechanism and a rail horizontally extended at an inclination about 15 degrees for guiding an inserted coin to the coin comparison mechanism. The small inclination of the rail allows a coin to be sent to the comparison mechanism at a speed slow enough for the coin comparison mechanism to accurately compare it with a sample coin.

Another object of the present invention is to provide a coin collecting mechanism with top coin slot that includes a coin return mechanism. The coin return mechanism includes a hood for covering the coin comparison mechanism, an inclined rail at a lower front end of the hood for guiding an inserted coin to the coin comparison mechanism, a spring-loaded member above the rail for pushing a jammed coin to a position that facilitates returning of the coin, and a position-adjustable locating clamp protruding toward the coin slot for easily setting a size of coin that is accepted to pass the coin slot.

A further object of the present invention is to provide a coin collecting mechanism with top coin slot, an electromagnetic valve of which has a return spring being completely mounted inside the valve body without affecting the function thereof. The return spring inside the valve body would not tangle with electric wires in the coin collecting mechanism to ensure smooth assembling and operation of the electromagnetic valve and the whole coin collecting mechanism.

To achieve the above and other objects, the present invention provides a coin collecting mechanism having a main support onto which a coin return mechanism and a coin comparison mechanism can be mounted at the same time. The coin comparison mechanism is in an upright position but inclines backward by about 15 degrees. The coin return mechanism includes a hood defining a downward opened chamber for the coin comparison mechanism to move up and down therein. The hood is provided at a lower front end with a horizontal rail inclined backward by about 15 degrees for catching an inserted coin vertically falling from the coin slot and guiding the coin into the coin comparison mechanism. The hood also has a spring-loaded member mounted to a front portion thereof for pushing a jammed coin out of the inclined rail. A locating clamp is adjustably mounted on the front portion of the hood for easily adjusting the size of the coin slot. And, an electromagnetic valve included in the coin collecting mechanism has a return spring mounted inside the valve body without the risk of contacting and tangling with electric wires outside the electromagnetic valve to adversely affect the assembling and operation of the whole coin collecting mechanism.

DETAILED DESCRIPTION OF THE PREFERRED EMBODIMENTS

Please refer to FIGS. 3 through 9, the present invention relates to a coin collecting mechanism with top coin slot and coin return function. To clearly show a basic structure of the coin collecting mechanism, accessories thereof, such as electric wires and circuit board, are omitted from the drawings.

Figure 1:
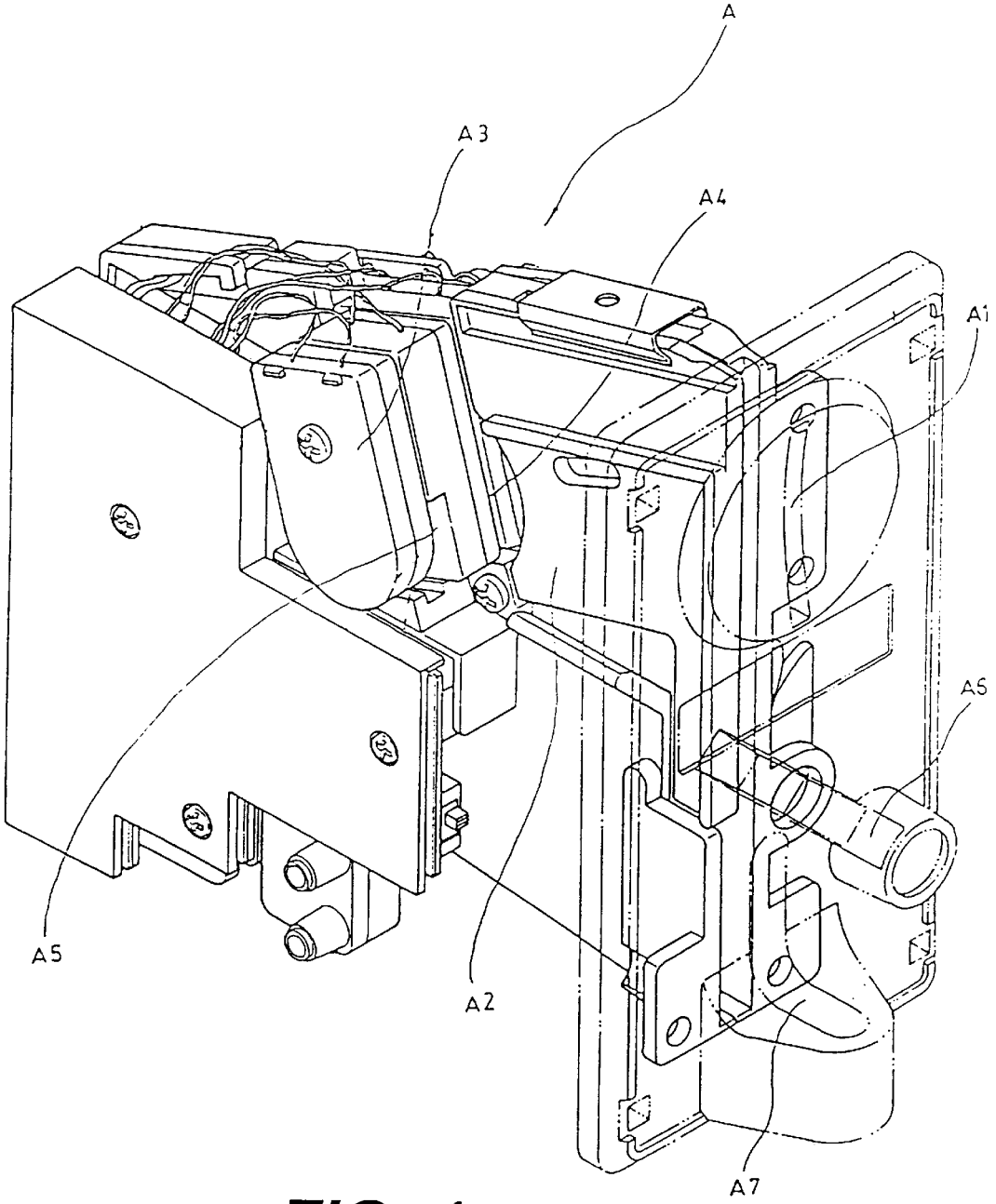
FIG. 1 PRIOR ART
FIG. 1 is a perspective of a conventional coin collecting mechanism with a side coin slot.
Figure 2:
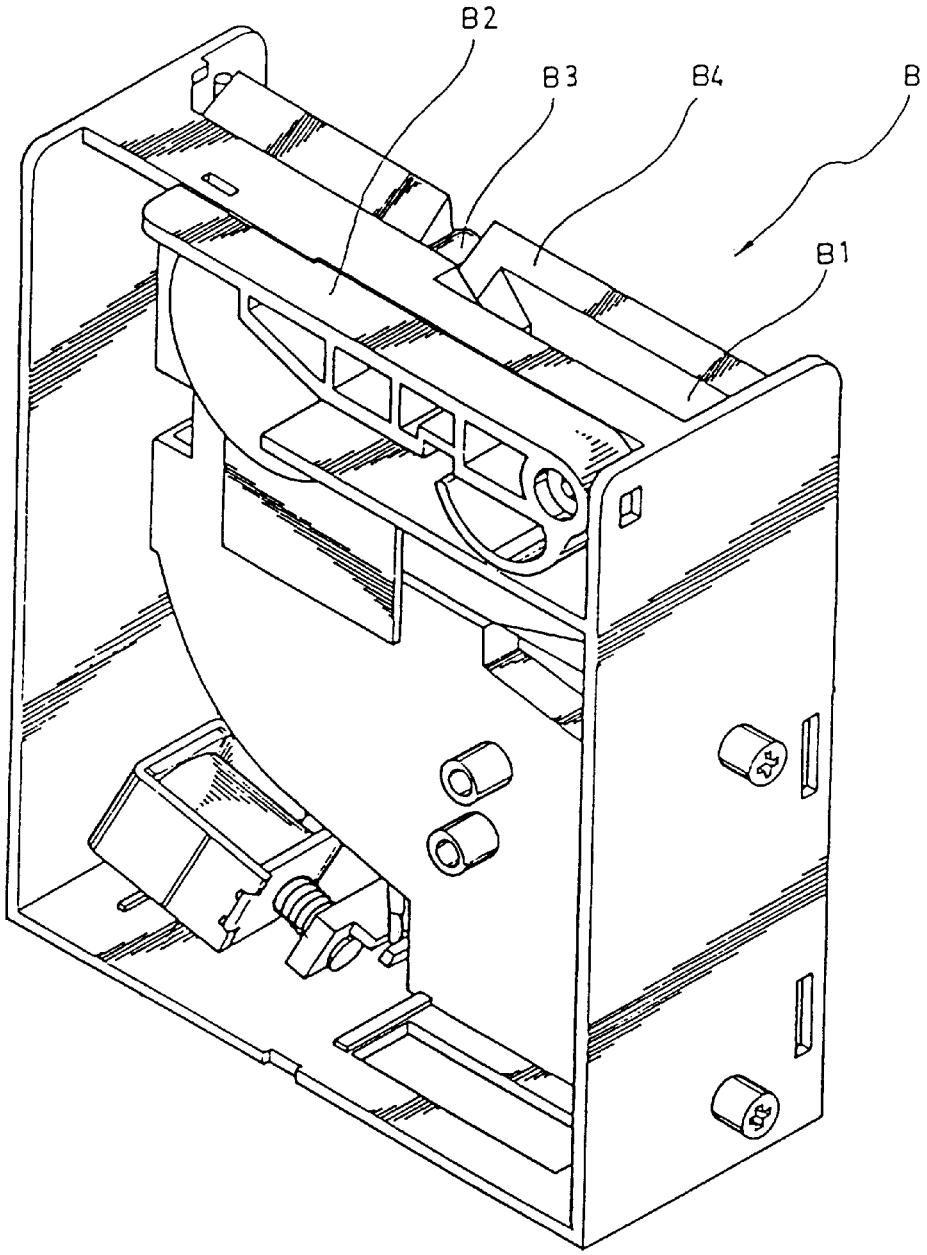
FIG. 2 PRIOR ART
FIG. 2 is a perspective of a conventional coin collecting mechanism with top coin slot.
Figure 3:
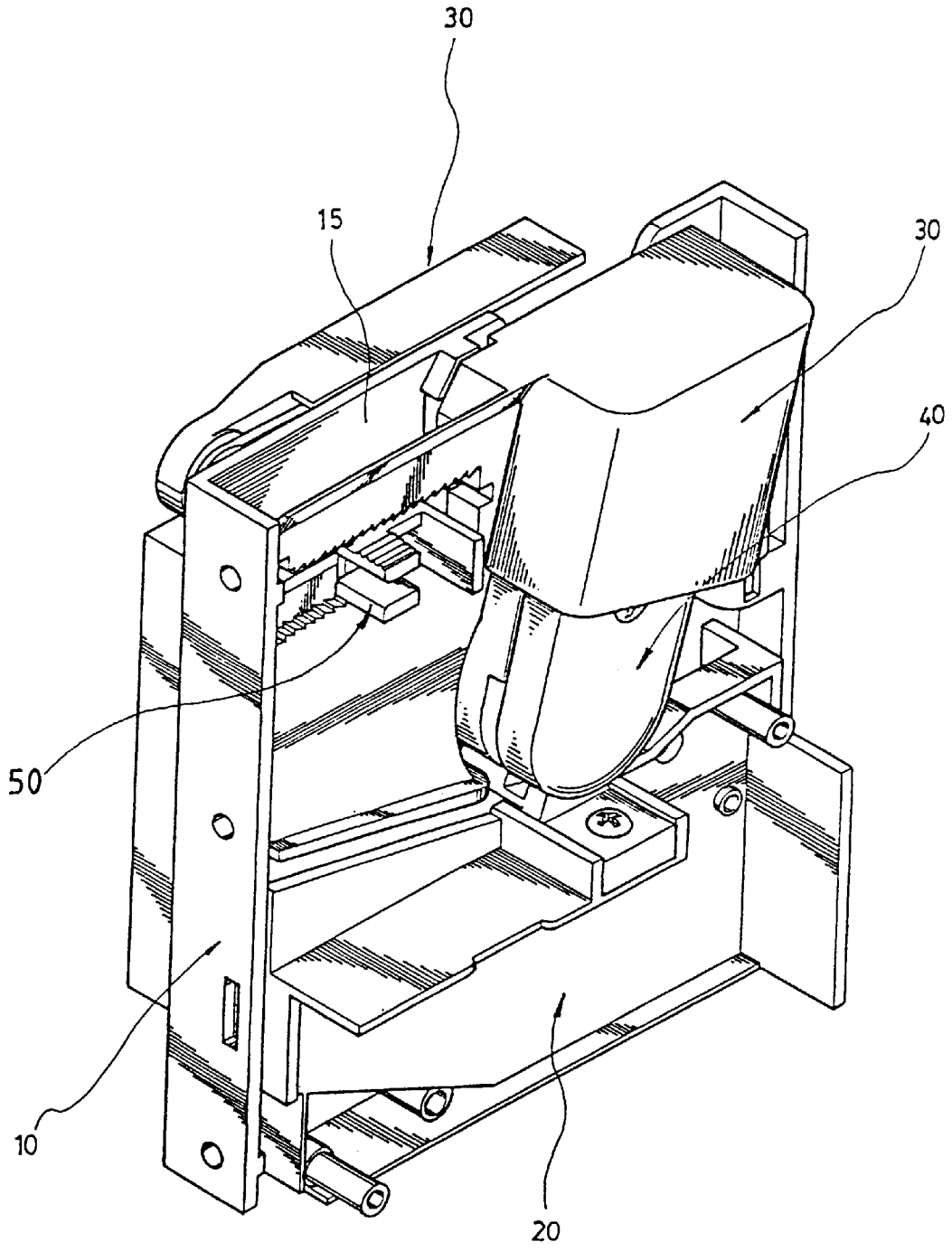
FIG. 3 is a perspective of a coin collecting mechanism according to the present invention viewed from right side thereof.
Figure 4:
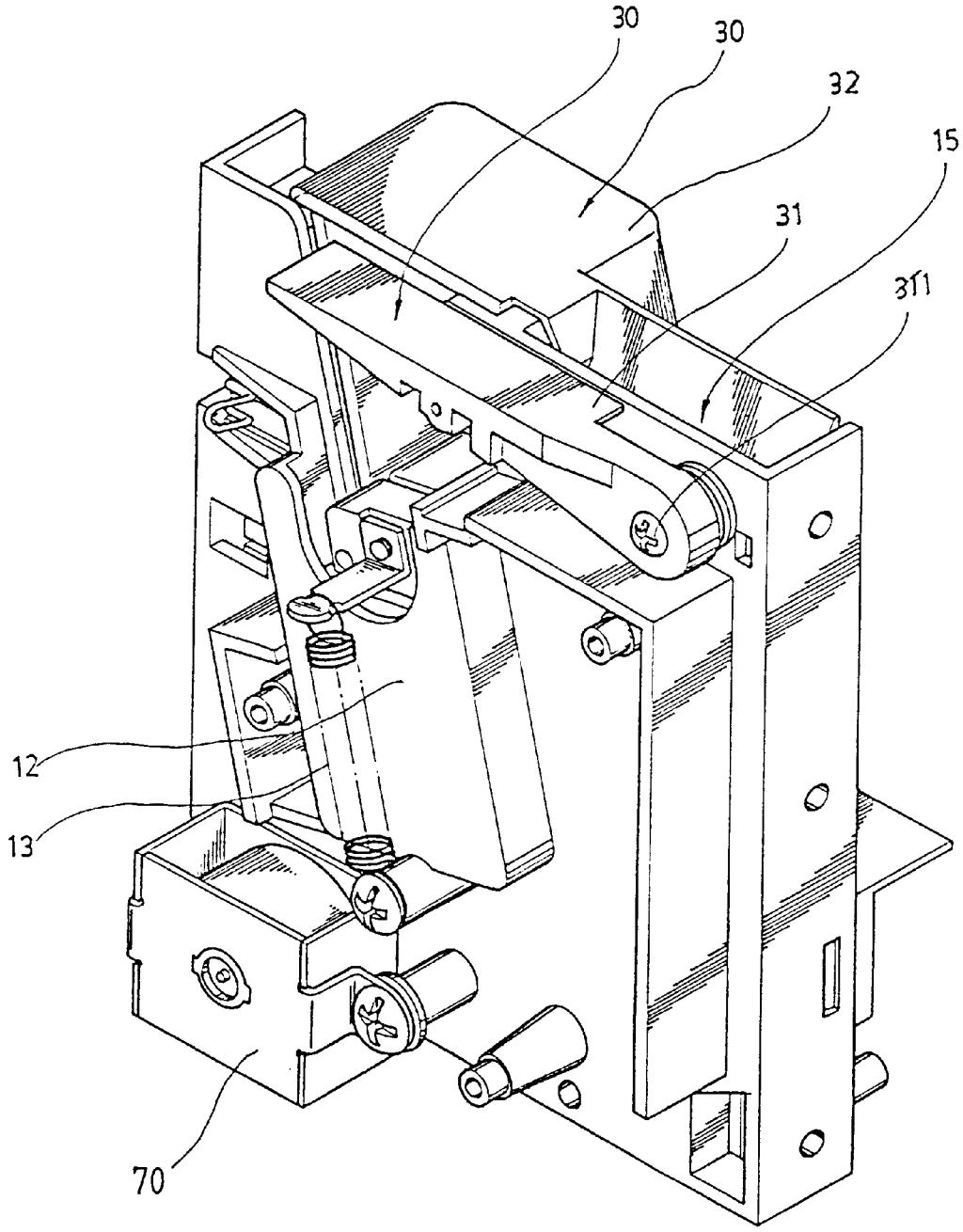
FIG. 4 is a perspective of the coin collecting mechanism of FIG. 3 viewed from left side thereof.
Figure 5:
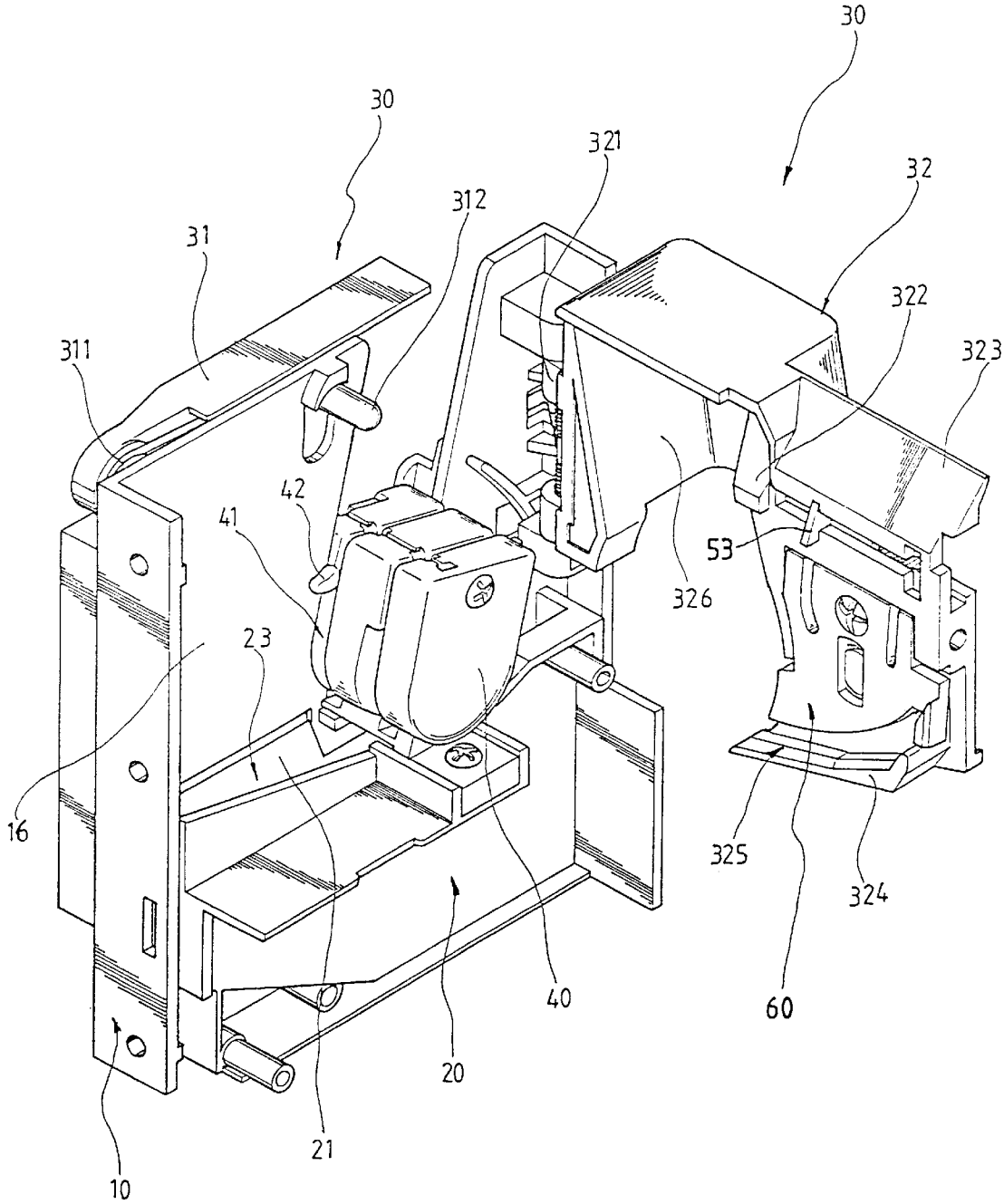
FIG. 5 is a perspective of the coin collecting mechanism of FIG. 3 with a hood of the coin return mechanism thereof in a fully pushed open position.

As shown in FIG. 3, 4 and 5, the coin collecting mechanism with top coin slot according to the present invention mainly includes a main support 10, a secondary support 20, a coin return mechanism 30, an electronic coin comparison mechanism 40, an adjustable locating clamp 50, a spring-loaded member 60, and an electromagnetic valve 70.

Figure 6:
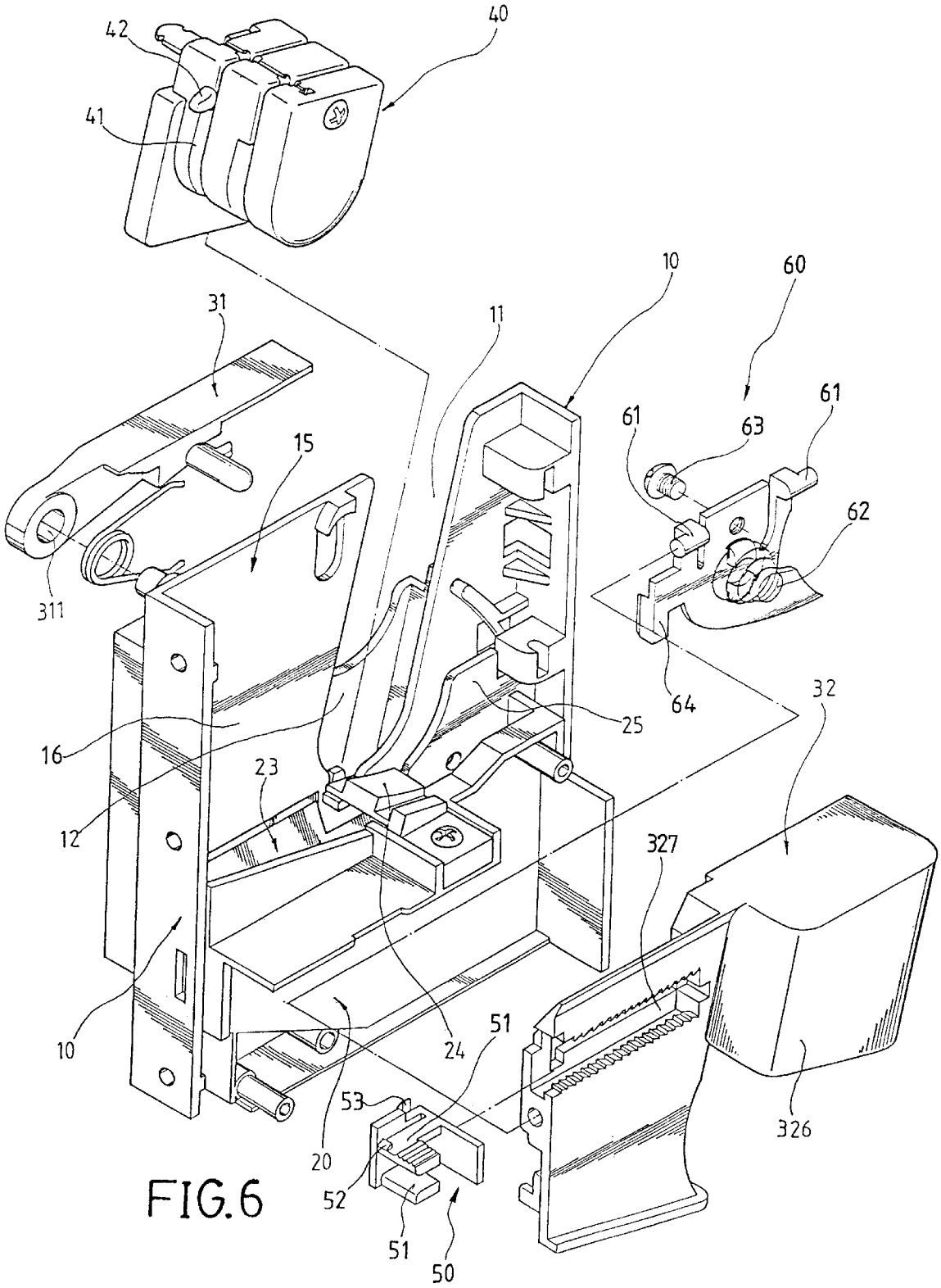
FIG. 6 is an exploded perspective of the coin collecting mechanism of the present invention.

Please refer to FIGS. 4 and 6, the main support 10 is provided near a mid-rear portion with an opening 11 vertically extended at an inclination about 15 degrees, and an upward opened chamber 12 is provided to a lower left side of the opening 11. The coin comparison mechanism 40 is seated in the opening 11 and the chamber 12 (see also FIG. 5) and may move up and down along the opening 11 during operation. A tension spring 13 (see FIG. 4) is connected at an upper end to the coin comparison mechanism 40 and at a lower end to a lower point on the main support 10, so as to normally keep the coin comparison mechanism 40 in a lowered position in the opening 11.

Figure 7:
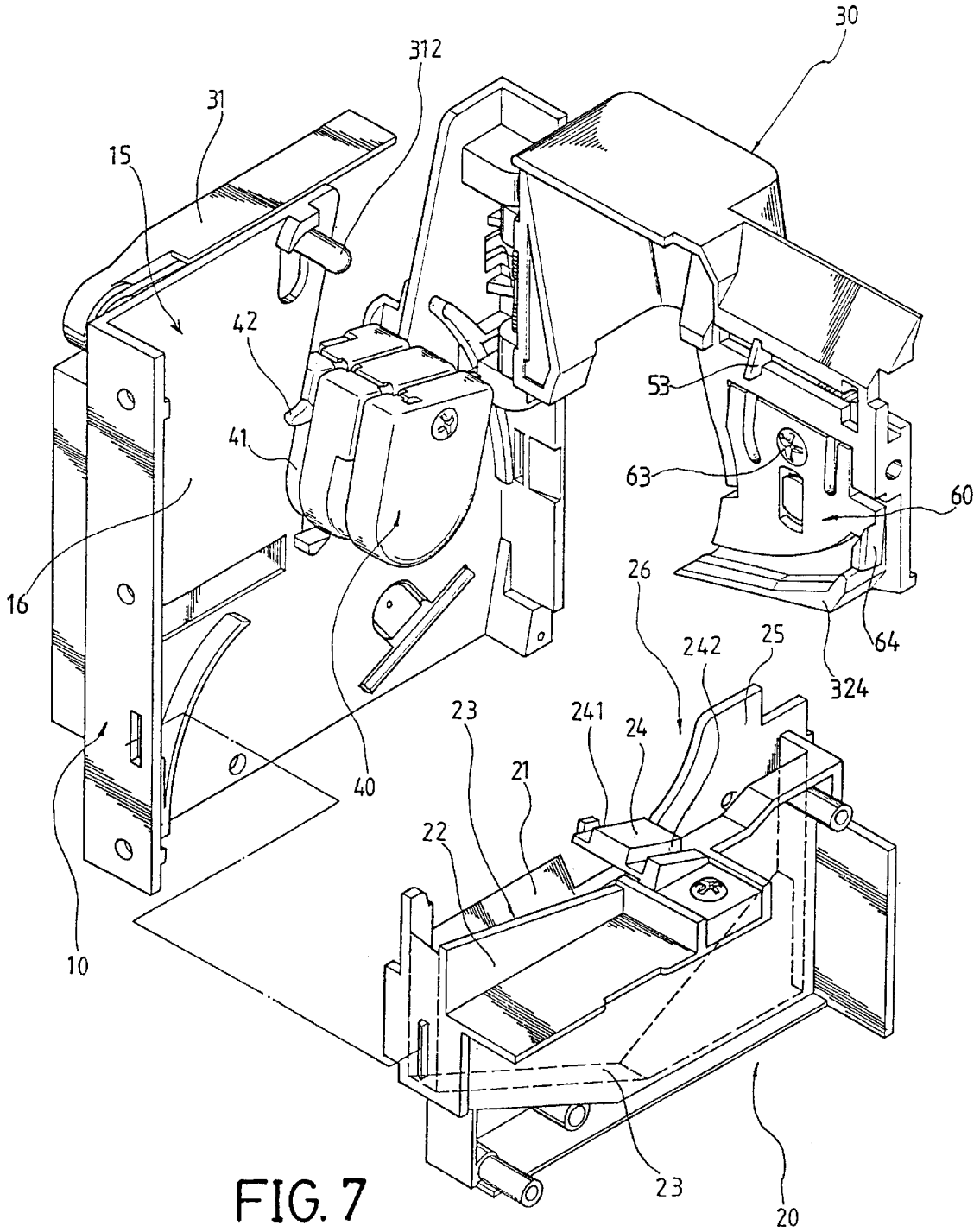
FIG. 7 is a fragmentary exploded perspective of the present invention.

The coin return mechanism 30 includes a handle 31 and a hood 32. The handle 31 is pivotally connected at one end to an upper front corner at the left side of the main support 10 by means of a pivot 311, so that a free end of the handle 31 points backward (FIG. 4). A bar 312 sideward projects from the handle 31 to extend into the right side of the main support 10 via a vertical long slot on the main support 10 (FIGS. 5, 6 and 7). The hood 32 is pivotally connected at a rear edge to an upper rear corner at the right side of the main support 10 by means of a spring pivot 321. A small inward and downward inclined surface 322 is provided at an inner side of the hood 32 corresponding to the bar 312, such that when the handle 31 is pushed downward, the bar 312 would touch and press against the inclined surface 322, causing the hood 32 to pivotally turn about the spring pivot 321 to move away from the main support 10 by a small distance (FIG. 5).

The secondary support 20 is connected to a lower half of the right side of the main support 10 (FIGS. 3 and 5), and includes a left inclined board 21 and a right upstanding board 22 that together define a middle passage 23 between them. A slideway support 24 is connected to a rear end of the middle passage 23 (FIGS. 6 and 7) to provide an inner slideway 241 and an outer slideway 242 thereon. A bottom of the middle passage 23 is communicable with an internal space generally defined by the secondary support 20. Another passage 26 exists between the main support 10 and a left wall 25 of the secondary support 20 (FIG. 6). The electromagnetic valve 70 controls a stopper 74, so that the stopper 74 may extend into or retreat from the passage 26 to close or open the passage 26, respectively. As a result, a coin may be guided to leave the main support 10 via a specific passage.

As shown in FIG. 5, the hood 32 has a big inclined surface 323 at its upper front portion. When the hood 32 is in a position closed to the main support 10, the inclined surface 323 and a side wall 16 of the main support 10 together define a coin slot 15 between them (FIGS. 3 and 4). A horizontally extended rail 324 is provided near a lower front edge of the hood 32 below the inclined surface 323. The rail 324 has a top surface inclined at about 15 degrees from a front end toward a rear end of the hood 32. When the hood 32 is in the position closed to the main support 10, the rail 324 and the side wall 16 of the main support 10 together define a slowly descended slideway 325 between them. A rear end of the slideway 325 leads and connects to the inner slideway 241. When the hood 32 is in the closed position, a coin (not shown) inserted into the coin slot 15 will fall vertically until it reaches the slideway 325. The coin is then guided by the slideway 325 to the inner slideway 241 at where the coin is examined by the coin comparison mechanism 40. In the event the coin is stuck in the slideway 325, the hood 32 may be pushed away from the main support 10 by downward pushing the handle 31, so that the coin falls from the slideway 325 onto the inclined board 21 of the secondary support 20 and drops into the passage 23 below the inclined board 21 before rolling to a coin return outlet.

A middle portion of the hood 32 defines a downward opened space 326 between the inclined surface 323 and the rear spring pivot 321. When the hood 32 is in the closed position, the coin comparison mechanism 40 is upward and downward movably located in the space 326. To position or replace a sample coin in the coin comparison mechanism 40, simply push the coin comparison mechanism 40 upward via a bottom side of the space 326.

Figure 8:
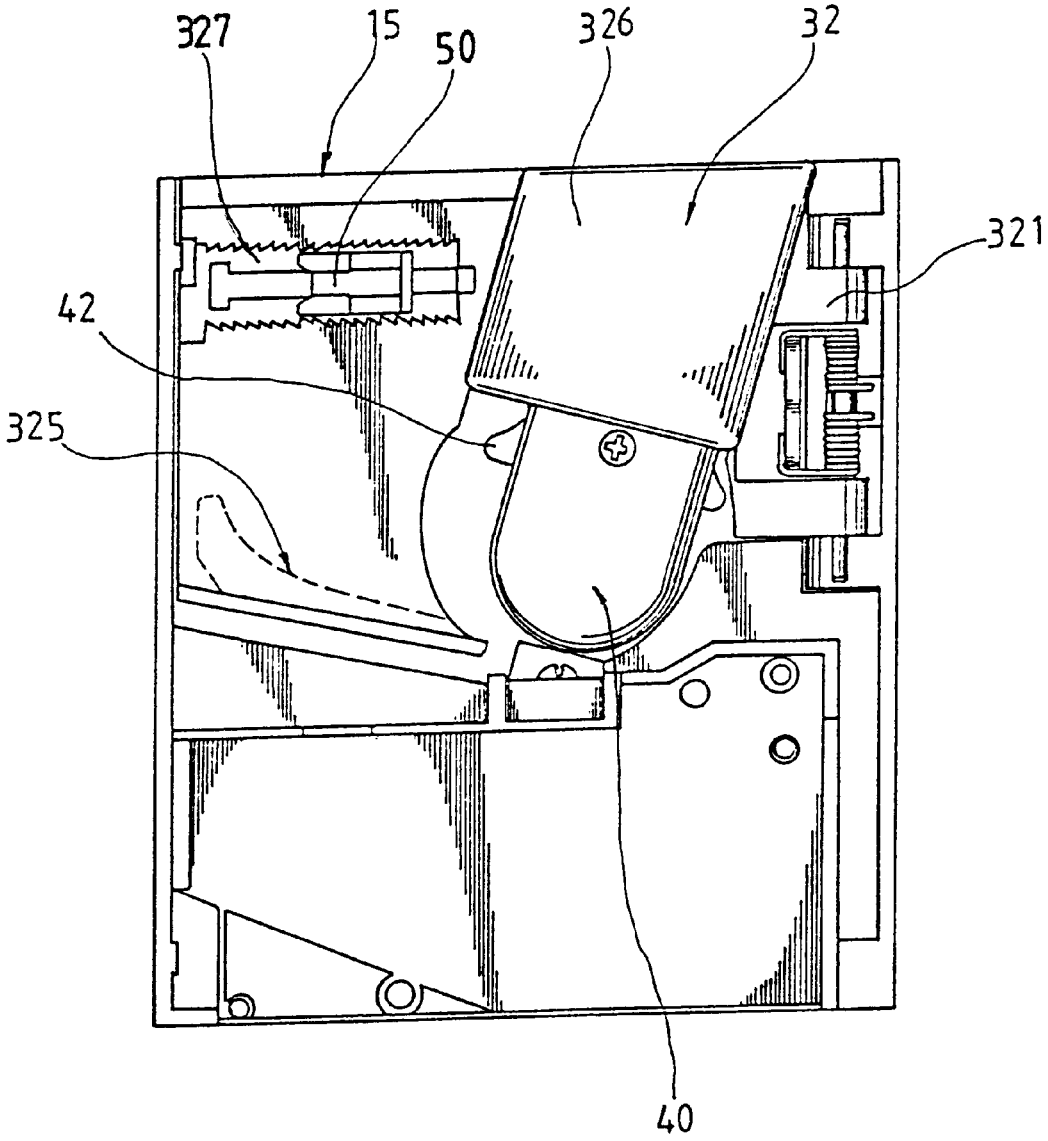
FIG. 8 is a right side plan view of the present invention.
Figure 9:
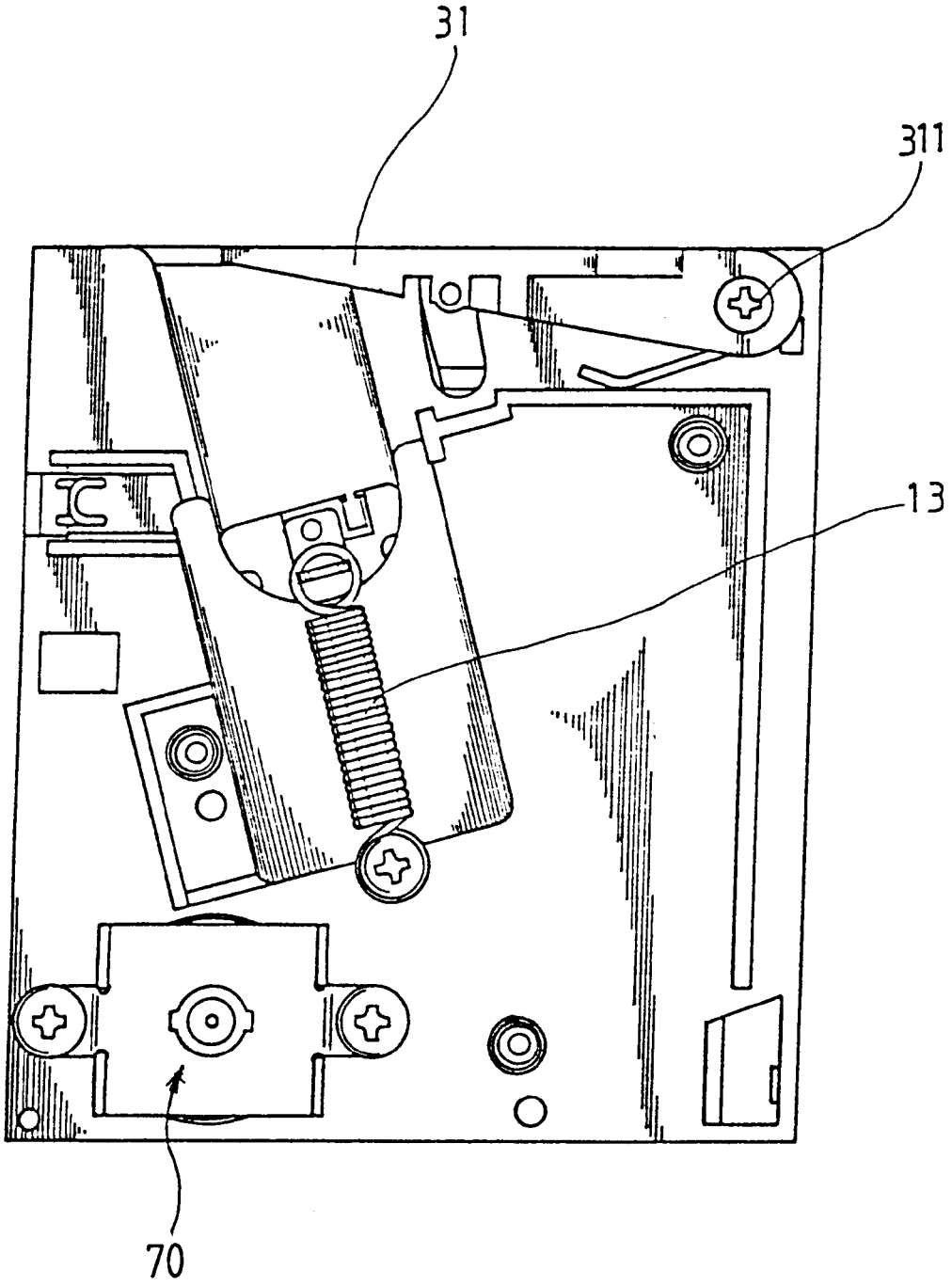
FIG. 9 is a left side plan view of the present invention.
Figure 10:
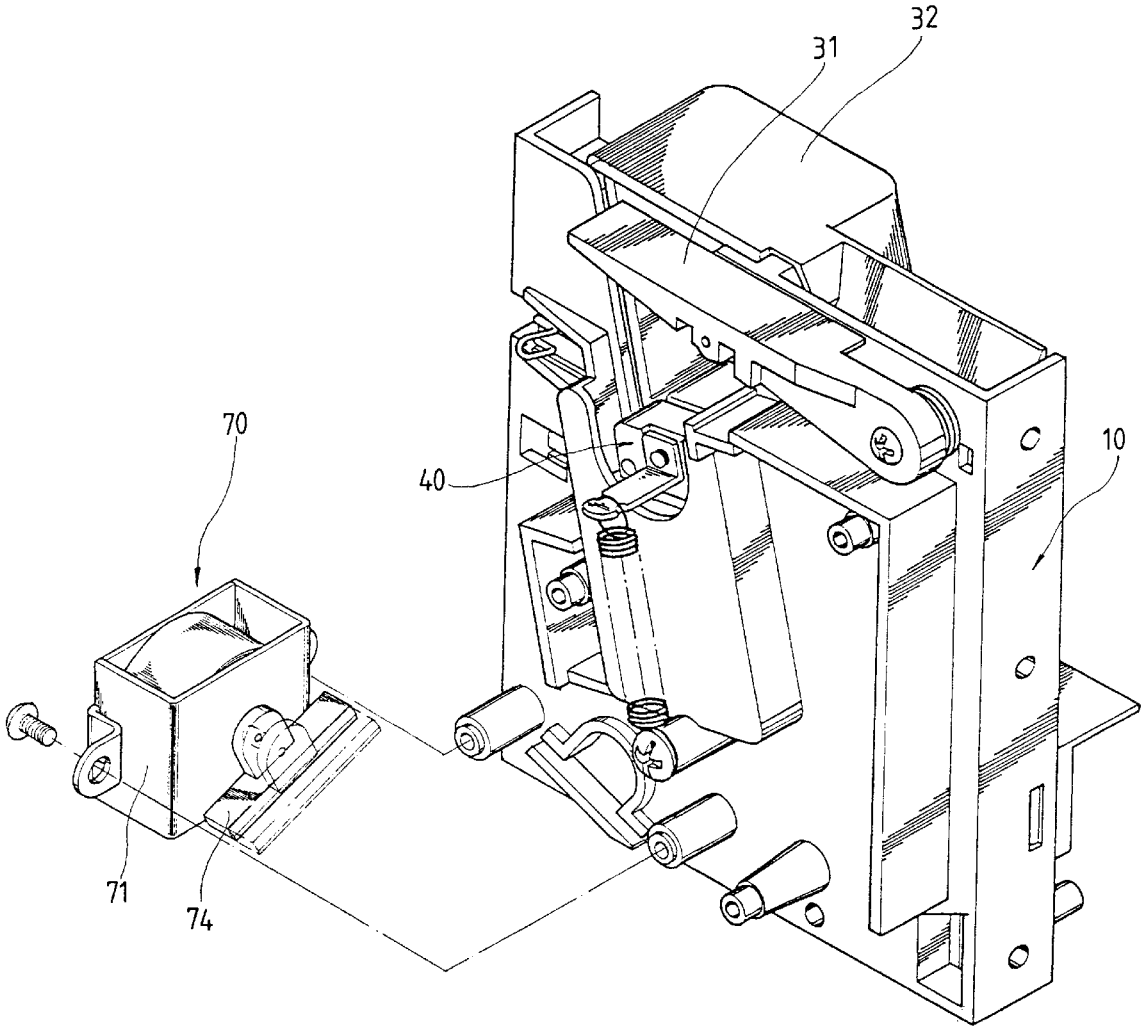
FIG. 10 is a partially exploded perspective showing an electromagnetic valve included in the present invention.
Figure 11:
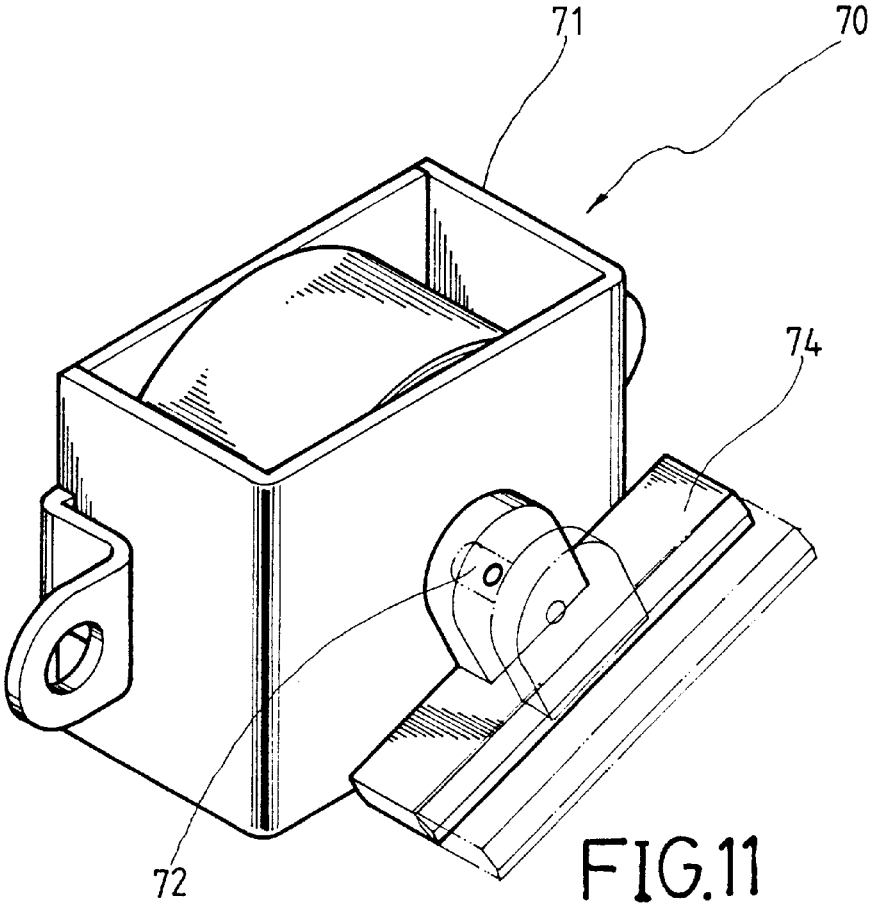
FIG. 11 is a perspective of the electromagnetic valve shown in FIG. 10.
Figure 12:
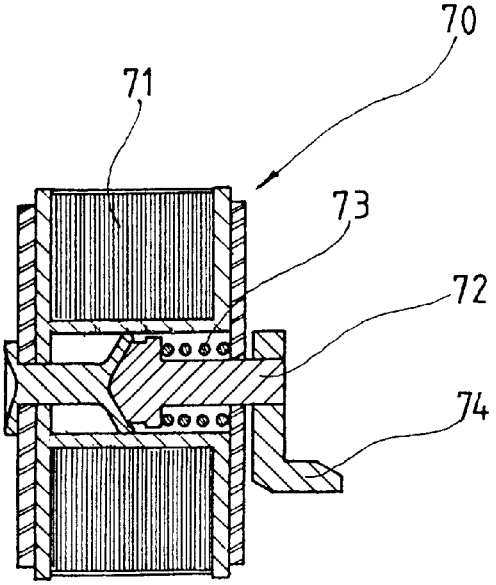
FIG. 12 is a side sectional view of the electromagnetic valve of FIG. 11.

The coin inserted into the coin slot 15 and vertically falling onto the slideway 325 shall change its moving direction by about 105 degrees and rolls toward a passage 41 in the coin comparison mechanism 40. To enable the coin to roll toward the passage 41 more stably, a curved tongue 42 is provided above the passage 41 (FIGS. 5, 6 and 7) to guide the coin into the coin comparison mechanism 40 quickly and stably, as shown in FIG. 8.

Although the rail 324 has a rearward slowly declined top surface to facilitate a smooth moving of the coin fallen onto the slideway 325, a width of the rail 324 considerably wide for catching and guiding the coin to the slideway 325 and the small distance available between the hood 32 swung away from the side wall 16 of the main support 10 for coin return purpose would still very possibly cause the coin to jam between the rail 324 and the side wall 16 when the hood 32 is pushed away from the main support 10 for the purpose of returning coin. To solve the problem of jammed coin during coin return operation, the spring-loaded member 60 is adjustably mounted on the hood 32 above the rail 324 (see FIGS. 5, 6 and 7). The spring-loaded member 60 includes pivots 61 at its top for easily pivotally connecting the spring-loaded member 60 to the hood 32. A spring 62 is fixed between the spring-loaded member 60 and the front portion of the hood 32 to normally push the spring-loaded member 60 away from the hood 32, and an adjusting screw 63 is threaded through a hole on the spring-loaded member 60 above the spring 62 for adjusting and controlling a minimum distance between the spring-loaded member 60 and the hood 32. The spring-loaded member 60 also has a locating head 64 at its front end to project toward the side wall 16 of the main support 10. The locating head 64 projects from the spring-loaded member 60 by a length larger than the width of the rail 324, whereby when the hood 32 is closed to the main support 10, the locating head 64 would touch the side wall 16 of the main support 10, so that the whole spring-loaded member 60 is pressed close to the hood 32 without blocking the rail 324 and accordingly the slideway 325. And, when the hood 32 is pushed away from the side wall 16 of the main support 10, a restoring force of the spring 62 would push the spring-loaded member 60 away from the hood 32, so that the spring-loaded member 60 is in a position protruded from the rail 324 and the slideway 325 capable of pushing the jammed coin out of the rail 324 and the slideway 325.

Please refer to FIG. 6. The coin return mechanism 30 is provided below the inclined surface 323 and above the spring-loaded member 60 with an internally toothed sliding slot 327 in parallel with the coin slot 15. The locating clamp 50 is associated with the toothed sliding slot 327 by extending two vertically spaced upper and lower clamping plates 51 horizontally projected from one side of the locating clamp 50 through the toothed sliding slot 327. Two cotters 52 are separately provided at upper and lower surfaces of the upper and lower clamping plates 51, respectively. Whereby when the two clamping plates 51 are compressed toward each other, the cotters 52 are separated from teeth of the toothed sliding slot 327 and the locating clamp 50 can therefore be shifted within and along the toothed sliding slot 327, and when the two clamping plates 51 are released, the cotters 52 would engage with teeth of the toothed sliding slot 327 to locate the locating clamp 50 at a fixed point in the toothed sliding slot 327. In brief, the position of the locating clamp 50 in the toothed sliding slot 327 may be easily adjusted by compressing or releasing the two clamping plates 51 toward or from one another. A beveled cotter 53 projects from another side of the locating clamp 50 to face and protrudes beyond the coin slot 15 (see FIGS. 3, 5, 6 and 7). A position of the beveled cotter 53 is adjustable by adjusting the position of the locating clamp 50 in the toothed sliding slot 327. The beveled cotter 53 is important in setting a selected size of coin in the coin slot 15 and therefore enabling the coin slot 15 to primarily screen coins inserted thereinto. Due to a bevel surface of the beveled cotter 53, any inserted coin having an exceeded diameter and jammed in the coin slot 15 can be guided downward by the bevel surface of the beveled cotter 53 to a straight and vertical position to facilitate returning of the inserted coin.

Please now refer to FIGS. 9 through 12. The electromagnetic valve 70 included in the present invention mainly includes a valve body 71, a retractable shaft 72, a return spring 73, and a stopper 74. The return spring 73 is mounted around a section of the retractable shaft 72 inside the valve body 71 (FIG. 12) and would not contact and tangle with any electric wires in the coin collecting mechanism of the present invention. This design is advantageous to a safe assembling and operation of the coin collecting mechanism.

What is claimed is:

1. A coin collecting mechanism with top coin slot and coin return function, comprising a main support, a secondary support, a coin return mechanism, an electronic coin comparison mechanism, an adjustable locating clamp, a spring-loaded member, and an electromagnetic valve, said electronic coin comparison mechanism being vertically mounted on an upward opening provided at a mid-rear portion of said main support, such that said electronic coin comparison. mechanism inclines backward by about 15 degrees and is movable up or down along the upward opening of the main support, and that a coin passage defined by an inner slideway on sail secondary support and said electronic coin comparison mechanism extends backward at an inclination of 15 degrees and wherein said electronic coin comparison mechanism includes a curved tongue provided above said coin passage, and said curved tongue being an integrally formed part of a predetermined component of the electronic coin comparison mechanism; and said coin return mechanism including a hood pivotally connected at a rear edge to a rear end of said main support by means of a spring pivot, a middle portion of said hood defining a downward opened chamber for said electronic coin comparison mechanism to upward and downward movably locate therein, and a lower front portion of said hood having a slideward projected and backward extended rail that together with said main support provide a slideway rearward and downward inclined by about 15 degrees;

whereby when a coin is inserted into a coin slot provided at a top of said main support, the coin would vertically fall and be caught and guided by said inclined slideway provided by said rail or said coin return mechanism to said coin passage of said electronic coin comparison mechanism.

2. A coin collecting mechanism as claimed in claim 1, wherein said spring-loaded member is mounted to an inner side of the front portion of said hood above said rearward inclined rail, said spring-loaded member including pivots at its top for easily pivotally connecting said spring-loaded member to the front portion of said hood, a spring fixed between said spring-loaded member and said hood to normally push said spring-loaded member away from said hood, and an adjusting screw threaded through a hole on said spring-loaded member above said spring for adjusting and controlling a minimum distance between said spring-loaded member and said hood; said spring-loaded member also having a locating head at its front end to touch an inner side surface of said main support, whereby when said hood is closed to said main support, the locating head touching said main support would cause said spring-loaded member to move closer to said hood without blocking said rail and said inclined slideway, and when said hood is pushed away from said main support, said spring would push said spring-loaded member away from said hood to protrude from the inclined rail and thereby pushes a jammed coin on said inclined slideway into said coin passage led to a coin return outlet.

3. A coin collecting mechanism as claimed in claim 1, wherein said hood of said coin return mechanism is provided at the front portion lower than said coin slot with an internally toothed sliding slot with which said locating clamp is associated; said locating clamp having cotters detachably engaging with teeth of the toothed sliding slot, allowing said locating clamp to selectively shift within said toothed sliding slot, said locating clamp also having a beveled cotter sideward protruding into said coin slot for guiding an inserted coin to a position suitable for comparison or return.

* * * * *